US012669037B2

(12) United States Patent
Labes

(10) Patent No.: US 12,669,037 B2
(45) Date of Patent: Jun. 30, 2026

(54) GREEN CARBON DIOXIDE INJECTION LINE COMPRESSION SYSTEM

(71) Applicant: FMC Technologies, Inc., Houston, TX (US)

(72) Inventor: Alan Zaragoza Labes, Woodlands, TX (US)

(73) Assignee: FMC Technologies, Inc., Houston, TX (US)

( * ) Notice: Subject to any disclaimer, the term of this patent is extended or adjusted under 35 U.S.C. 154(b) by 65 days.

(21) Appl. No.: 18/626,850

(22) Filed: Apr. 4, 2024

(65) Prior Publication Data

US 2025/0314154 A1 Oct. 9, 2025

(51) Int. Cl.
*E21B 41/00* (2006.01)

(52) U.S. Cl.
CPC ..... *E21B 41/0064* (2013.01)

(58) Field of Classification Search
CPC ..... E21B 41/0064; E21F 17/16; F17C 3/005
See application file for complete search history.

(56) References Cited

U.S. PATENT DOCUMENTS

| | | | | |
|---|---|---|---|---|
| 2011/0079017 | A1 | 4/2011 | Guelen et al. | |
| 2014/0020388 | A1* | 1/2014 | Salazar | F01K 23/10 60/689 |
| 2018/0155202 | A1* | 6/2018 | Alekseev | H02K 7/1823 |
| 2024/0335783 | A1* | 10/2024 | Song | B01D 53/62 |

FOREIGN PATENT DOCUMENTS

| | | | | |
|---|---|---|---|---|
| CN | 201152197 | Y | 11/2008 | |
| CN | 106014512 | A * | 10/2016 | F01K 11/02 |
| CN | 107084401 | B | 3/2019 | |
| CN | 114382562 | B * | 11/2022 | F01K 21/04 |
| CN | 115614120 | A * | 1/2023 | B65G 5/00 |
| CN | 117658072 | A | 3/2024 | |
| CN | 119712277 | A * | 3/2025 | |
| CN | 120026958 | A * | 5/2025 | F01K 21/04 |
| EP | 2594528 | A1 * | 5/2013 | C01B 3/382 |
| KR | 20230140846 | A | 10/2023 | |
| WO | WO-2023195985 | A1 * | 10/2023 | F01K 17/04 |

OTHER PUBLICATIONS

International Search Report and Written Opinion from PCT/US2025/023108, dated Jul. 22, 2025.

* cited by examiner

*Primary Examiner* — Jong-Suk (James) Lee
(74) *Attorney, Agent, or Firm* — Kevin E. West; Advent, LLP

(57) ABSTRACT

A carbon dioxide injection line compression system, including a turbine, an oxygen combustion chamber, a storage site and main carbon dioxide storage line having a compressor. The compressor compresses carbon dioxide gas in the main carbon dioxide storage line prior to storing the carbon dioxide gas at the storage site. The oxygen combustion chamber is configured to burn a fuel in an oxygen rich environment to generate energy and a gaseous mixture comprising carbon dioxide and steam. The carbon dioxide generated in the oxygen combustion chamber is added to the main carbon dioxide storage line. The oxygen combustion chamber is in energy communication with the turbine which is, in turn, configured to drive the compressor.

20 Claims, 7 Drawing Sheets

GREEN CARBON DIOXIDE INJECTION LINE COMPRESSION SYSTEM

TECHNICAL FIELD

The present disclosure provides a carbon dioxide injection line compression system and a method for injection line compression.

BACKGROUND

Carbon capture and storage is a process where carbon dioxide from a carbon dioxide generating process (or from the air) is "captured" (i.e. separated) and stored at a storage site such as an underground reservoir, a depleted oil or gas field, or a deep rock reservoir beneath the sea. As part of this process, the carbon dioxide generated may need to be compressed prior to injection into the storage site. This method prevents the release of the carbon dioxide into the atmosphere and reduces or mitigates the contribution that said carbon dioxide would have on global warming.

DRAWINGS

The Detailed Description is described with reference to the accompanying figures. The use of the same reference numbers in different instances in the description and the figures may indicate similar or identical items. Embodiments of the present disclosure will now be described by way of example only and with reference to the accompanying drawings, in which.

DETAILED DESCRIPTION

Figure 1:
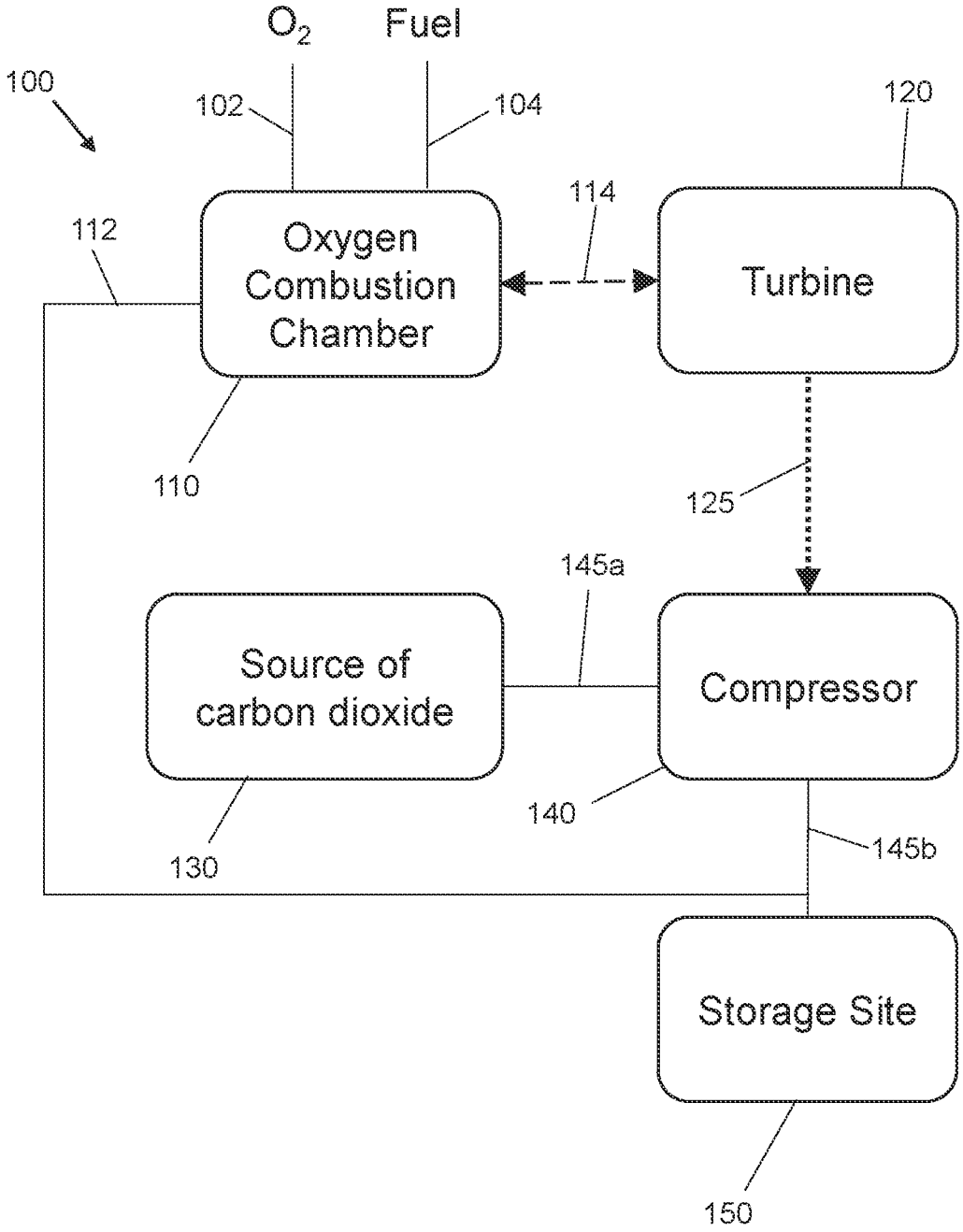
FIG. 1 shows a schematic representation of a carbon dioxide injection line compression system in accordance with an example embodiment of the present disclosure.

For the purposes of promoting an understanding of the principles of the subject matter, reference will now be made to the embodiments illustrated in the drawings and specific language will be used to describe the same. It will nevertheless be understood that no limitation of the scope of the subject matter is thereby intended. Any alterations and further modifications in the described embodiments, and any further applications of the principles of the subject matter as described herein are contemplated as would normally occur to one skilled in the art to which the subject matter relates.

Overview

The process of compressing and injecting carbon dioxide is typically an energy intensive process and thus highly costly. For example, compressing the carbon dioxide for storage may itself be energy intensive. Furthermore, the carbon dioxide generating process, such as oxygen combustion processes where carbon-based fuels (such as natural gas, coal or oil) are burned in an oxygen rich environment, typically require high temperatures and therefore high energy consumption.

In today's society, there is a strong drive towards green processes which reduce the net carbon emissions of the overall process and are more economical to implement. Thus, the present disclosure aims to provide a carbon capture and storage system such as aa carbon dioxide injection line compression system, that is energy efficient and economical.

In a first aspect of the present disclosure, a system (e.g. carbon dioxide injection line compression system, e.g. carbon capture and storage system) is provided. The system comprises:

- a main carbon dioxide storage line connecting a carbon dioxide source with a storage site such that the main carbon dioxide storage line is configured to transport carbon dioxide gas from the carbon dioxide source to the storage site;
- where the main carbon dioxide storage line includes a compressor in fluid communication with, and upstream of, the storage site and wherein the compressor is configured to compress carbon dioxide gas prior to storing the carbon dioxide gas at the storage site;
- a turbine configured to drive the compressor;
- an oxygen combustion chamber configured to burn a fuel in an oxygen rich environment to generate energy and a gaseous mixture comprising carbon dioxide and steam,
- wherein, at least a part of the energy generated is used to drive the turbine; and
- wherein the oxygen combustion chamber is in fluid communication with, and upstream of, the storage site such that carbon dioxide generated in the oxygen combustion chamber is added to the main carbon dioxide storage line.

In a second aspect of the present disclosure, a method for injection line compression of carbon dioxide is provided. The method comprises:

- generating energy and a gaseous mixture comprising steam and carbon dioxide by burning fuel in an oxygen rich environment in an oxygen combustion chamber;
- adding the carbon dioxide generated in the oxygen combustion chamber to a main carbon dioxide storage line, wherein the main carbon dioxide storage line extends between a carbon dioxide source and a storage site, and wherein the main carbon dioxide storage line comprises a compressor;
- driving the compressor to compress the carbon dioxide gas provided thereto upstream of the storage site, wherein the compressor is driven by a turbine and the turbine is driven by the energy generated in the oxygen combustion chamber; and
- transporting the carbon dioxide in the main storage line to the storage site.

It will thus be appreciated that the carbon dioxide injection line compression carbon capture and storage system of the first aspect may implement the method of the second aspect. Both aspects therefore provide a system and method where (e.g. thermal) energy generated by a combustion process (i.e. burning fuel in an oxygen rich environment) in the oxygen combustion chamber is used to drive a compressor via a turbine which is in energy communication with the oxygen combustion chamber. The compressor is, in turn, used to compress carbon dioxide provided from a main (e.g. external) carbon dioxide source (i.e. separate and distinct from the carbon dioxide generated in the oxygen combustion chamber) via the main carbon dioxide line. As such, the energy required to work the compressor and compress the carbon dioxide (provided via a main carbon dioxide storage line from an external carbon dioxide generation process, and, in embodiments, generated in the oxygen combustion chamber), is internally generated within the system, thus reducing and/or eliminating the need for external energy sources to power the compressor and thus improving the energy efficiency of the process.

The present disclosure as provides a system for injecting carbon dioxide at a storage site with improved energy efficiency that utilizes the power from an oxygen combustion process to power a compressor which is, in turn, used to compress carbon dioxide from a different (e.g. main or external) carbon dioxide source, thus reducing the external energy requirements of the process. Furthermore, in the present disclosure, a system is provided where carbon dioxide generated in the oxygen combustion process used to power the compressor is further combined with the carbon dioxide from the external carbon dioxide source upstream or downstream of the compressor.

The following provides various features and embodiments of the first and second aspects of the disclosure. It will be appreciated that any suitable and/or desirable number, arrangement and/or combination the following optional features may be implemented in any suitable and/or desirable way to provide an embodiment falling within the scope of the first or second aspects of the disclosure.

In embodiments, the carbon dioxide generated in the oxygen combustion chamber is added to the main carbon dioxide storage line upstream of the compressor. In embodiments, the carbon dioxide generated in the oxygen combustion chamber is added to the main carbon dioxide storage line downstream of an output of the compressor. As such, the carbon dioxide generated in the oxygen combustion chamber may be combined with carbon dioxide from other sources (either upstream or downstream of the compressor) before storage at the storage site. In embodiments, the carbon dioxide source (separate from the oxygen combustion chamber) may be a process plant for transporting carbon dioxide to a place for storage.

In embodiments, the storage site is an underground reservoir or well, a depleted oil or gas field or a deep rock reservoir beneath the sea or any other suitable and/or desirable storage location configured for carbon dioxide storage.

In embodiments, the oxygen combustion chamber comprises an oxygen input (e.g. in communication with an oxygen source) and a carbon-based fuel input (e.g. in communication with an fuel source). The fuel may be any suitable and/or desirable carbon-based fuel such as natural gas, oil or coal. The fuel may be a natural gas, e.g. methane. In embodiments, the oxygen combustion chamber comprises an output for outputting the gaseous mixture, wherein the output is in fluid communication with the storage site.

In embodiments, the carbon dioxide injection line compression system, further comprises a purification module configured to separate the carbon dioxide in the gaseous mixture from the water in the gas. In embodiments, the purification module comprises a carbon dioxide output in fluid communication with the storage site. In embodiments, the method comprises separating, in a purification module, the carbon dioxide in the gaseous mixture from the water in the gaseous mixture. In embodiments, the method comprises outputting the carbon dioxide from the purification module to the compressor and/or the storage site.

In embodiments, the purification module comprises an input in fluid communication with the output of the oxygen combustion chamber and a carbon dioxide output in fluid communication with the storage site.

In embodiments, the purification module comprises a first carbon dioxide output in fluid communication with the oxygen combustion chamber such that a portion of the carbon dioxide in the gaseous mixture is circulated back into the oxygen combustion chamber; and a second carbon dioxide output in fluid communication with the compressor and/or storage site. In embodiments, the purification module further comprises a water (e.g. steam) output. The first carbon dioxide output thus allows a portion of the carbon dioxide to be recirculated back to the oxygen combustion chamber to control the combustion process therein (e.g. controlling the combustion reaction to influence temperature and/or pressure). The portion may be determined by a compressor in this line, not shown.

In embodiments, the method comprises recirculating a first portion of the carbon dioxide separated in the purification module back into the oxygen combustion chamber. In embodiments, the method comprises providing a second portion of the carbon dioxide separated in the purification module to the compressor and/or the storage site.

In embodiments, the purification module further comprises a separation unit in fluid communication with, and upstream of, a dehydration unit. In embodiments, the separation unit is configured to remove at least some of the water from the gaseous mixture, generated in the oxygen combustion chamber, to provide a carbon dioxide rich stream that is passed to the dehydration unit. In embodiments, the separation unit comprises a first water (e.g. steam) output. In embodiments, the dehydration unit is configured to further dehydrate the carbon dioxide rich stream. In embodiments, the dehydration unit comprises a second water (e.g. steam) output.

In embodiments, a separation unit comprises a first carbon dioxide output configured to recirculate carbon dioxide to the oxygen combustion chamber and a third carbon dioxide output configured to provide carbon dioxide to the dehydration unit or the compressor or the downstream storage site. In embodiments, the separation unit comprises a first water (e.g. steam) output. In embodiments, the dehydration unit is in fluid communication with, and downstream from, the third carbon dioxide output, wherein the dehydration unit comprises a second water output and the second carbon dioxide output. In embodiments, the second carbon dioxide output is in fluid communication with the compressor and/or the storage site.

In embodiments, the water (e.g. steam) output from the purification module (e.g. via the water output, the first water output and/or the second water output) may be in fluid communication with a steam consuming process. For example, the water (e.g. steam) output from the purification module (e.g. via the water output, the first water output and/or the second water output) may be in fluid communication with, and upstream of, a steam reforming module (as described below.

In embodiments, the method comprises mixing the carbon dioxide output from the separation unit and/or the dehydration unit with the carbon dioxide from a further (e.g. different) upstream carbon dioxide generating process to provide a mixed stream of carbon dioxide; and passing the mixed stream into the compressor to be compressed prior to storage at the storage site. In embodiments, the method comprises mixing the carbon dioxide output from the separation unit and/or the dehydration unit with compressed carbon dioxide gas output from the compressor; and passing the pressurised stream of carbon dioxide to the storage site.

In embodiments, the (e.g. output of the) oxygen combustion chamber and/or the carbon dioxide output of the purification module is in fluid communication with, and upstream of, the compressor. For example, when the carbon dioxide output from the oxygen combustion chamber and/or the carbon dioxide output of the purification module has a pressure that is less than or equal to the pressure of carbon dioxide being input into the compressor, the carbon dioxide may be compressed prior to storage. For example, when the carbon dioxide output from the oxygen combustion chamber and/or the carbon dioxide output of the purification module has a pressure that is less than a pressure threshold required for (e.g. underground) storage, the carbon dioxide may need to be compressed upstream of the storage site. As such, the carbon dioxide generated in the oxygen combustion chamber may be passed to the compressor (e.g. via the purification module) to be compressed prior to input (e.g. injection) at the storage site. The method may thus further comprise adding (e.g. passing) the carbon dioxide generated in the oxygen combustion chamber to the main storage line upstream of the compressor such that the carbon dioxide is compressed and pressurised upstream of the storage site.

In embodiments, the (e.g. output of the) oxygen combustion chamber and/or the carbon dioxide output of the purification module is in fluid communication with, and upstream of, an output of the compressor. For example, when the carbon dioxide output from the oxygen combustion chamber and/or the carbon dioxide output of the purification module has a pressure that is greater than or equal to the pressure of carbon dioxide being input into the compressor, it may not be necessary to compress the carbon dioxide further. For example, when the carbon dioxide output from the oxygen combustion chamber and/or the carbon dioxide output of the purification module has a pressure that is greater than a pressure threshold required for (e.g. underground) storage, the carbon dioxide output from the oxygen combustion chamber may not need to be compressed upstream of the storage site. As such, the carbon dioxide generated in the oxygen combustion chamber may be passed (e.g. directly) for input (e.g. injection) at the storage site (e.g. via a purification module) without passing through the compressor and/or mixed with the output of the compressor before being passed for input (e.g. injection) at the storage site. The method may thus further comprise passing the carbon dioxide generated in the oxygen combustion chamber (e.g. via the purification module) to the storage, bypassing the compressor. The method may thus further comprise adding (i.e. mixing) the carbon dioxide generated in the oxygen combustion chamber to the main storage line downstream of the compressor (e.g. to mix it with a compressed carbon dioxide gas output from the compressor) to provide a mixed stream of pressurised carbon dioxide; and transporting (e.g. via the main line) the mixed stream of pressurised carbon dioxide to the storage site.

In embodiments, the compressor includes a plurality of compression stages (e.g. arranged in series) comprising a first compression stage and one or more subsequent compression stages. For example, the pressure of the fluid (i.e. carbon dioxide) in each compression stage is greater than the pressure of the fluid (i.e. carbon dioxide) in the stage prior. In such embodiments, the carbon dioxide generated in the oxygen combustion chamber is added to the main carbon dioxide storage line at one of the one or more subsequent compression stages. In other words, the output of the oxygen combustion chamber and/or the carbon dioxide output of the purification module may be in fluid communication, and upstream of, one or more of the subsequent compression stages. As such, when the carbon dioxide output from the oxygen combustion chamber and/or the carbon dioxide output of the purification module has a pressure that is greater than the pressure of the carbon dioxide being input to the compressor and less than the pressure of the carbon dioxide being output from the compressor (or less than the pressure threshold for storage), the carbon dioxide output from the oxygen combustion chamber and/or the carbon dioxide output of the purification module may be passed to a suitable subsequent compression stage for further compression. In other words, the carbon dioxide output from the oxygen combustion chamber and/or the carbon dioxide output of the purification module may be directed towards the first subsequent compression stage (e.g. in the sequence of subsequent pressure stages) having a pressure greater than the pressure of the carbon dioxide output from the oxygen combustion chamber.

For example, if the compressor comprises five stages (the first compression stage and four subsequent compression stages) and the pressure of the carbon dioxide output from the oxygen combustion chamber and/or the carbon dioxide output of the purification module is greater than the carbon dioxide in the first two compression stages (i.e. the first compression stage and the first subsequent compression stage) and less than the carbon dioxide in the last three compression stages (i.e. the third, fourth and fifth compression stages), the carbon dioxide output from the oxygen combustion chamber and/or the carbon dioxide output of the purification module may be directed into the third compression stage to undergo further compression in the third, fourth and fifth compression stages. The method may thus comprise passing the carbon dioxide output from the oxygen combustion chamber and/or the carbon dioxide output of the purification module to a subsequent compression stage of the compressor.

In embodiments the (e.g. carbon capture and storage, e.g. carbon dioxide injection line compression) system further comprises a steam reforming module configured to generate hydrogen from natural gas and steam. In embodiments, the steam reforming module comprises a catalyst. In embodiments, the steam reforming module is in energy (e.g. thermal) communication with the oxygen combustion chamber such that (e.g. at least a part of) the (e.g. thermal) energy generated in the oxygen combustion chamber is configured to heat the steam and natural gas within the steam reforming module. As such, instead of losing the (e.g. thermal, e.g. latent and sensible heat) energy generated in the oxygen combustion chamber to the atmosphere as waste energy, the (e.g. thermal, e.g. latent and sensible heat) energy generated is used within the (e.g. carbon capture and storage, e.g. carbon dioxide injection line compression) system to heat the steam reformation process. This therefore helps to reduce the energy requirements of the system and method.

In embodiments, the (e.g. thermal, e.g. sensible, e.g. latent) energy generated in the oxygen combustion chamber is the sole heat source used to heat the steam and natural gas within the steam reforming module. In other words, there are no external heating means used to heat the steam reforming module. In embodiments, the steam and natural gas is heated to temperatures from seven-hundred degrees Celsius (700° C.) to one-thousand one-hundred degrees centigrade (1100° C.).

In embodiments, the method further comprises generating a synthesis gas (syngas) in a steam reforming module by heating a mixture of natural gas and steam, e.g. to a temperature between seven-hundred degrees Celsius (700° C.) to one-thousand one-hundred degrees centigrade (1100° C.). In embodiments, the mixture of natural gas and steam is heated in the presence of a catalyst. In embodiments, the method comprises using the thermal energy generated in the oxygen combustion chamber is as the (e.g. sole) source of heat to heat the steam reforming module. In embodiments, the method comprises heating the steam reforming module (e.g. by the thermal energy generated in the oxygen combustion chamber) to a temperature from seven-hundred degrees Celsius (700° C.) to one-thousand one-hundred degrees centigrade (1100° C.).

In embodiments, the steam reforming module is configured to output a carbon-based gas stream. In embodiments, the carbon-based gas stream is input to the oxygen combustion chamber, e.g. for further combustion.

In embodiments, the steam reforming module comprises a steam input in fluid communication with a source of steam, a natural gas input in fluid communication with a source of natural gas, a carbon-based gas output in fluid communication with the oxygen combustion chamber such that the carbon-based gas generated in the steam reforming module is input to the oxygen combustion chamber; and a hydrogen gas output for outputting hydrogen gas.

In embodiments, the steam reforming module comprises a reactor module in (e.g. thermal) energy communication with the oxygen combustion chamber such that heat from the oxygen combustion chamber is transferred to (or exchanged with) the reactor module, e.g. to heat the reactor module. In embodiments, the reactor module is configured to generate a syngas by heating natural gas in the presence of steam and, in some embodiments, a catalyst. In embodiments, the reactor module generates a gaseous mixture comprising a carbon-based gas and hydrogen gas.

In embodiments, the steam reforming module further comprises a separation module in fluid communication with, and downstream of, the reactor module. In embodiments, the separation module is configured to separate the syngas into a carbon-based gas stream and a hydrogen gas stream. In embodiments, the hydrogen gas stream is output from the steam reforming module via a hydrogen gas output. In embodiments, the separation module is configured to input the carbon-based gas stream to the oxygen combustion chamber. There is thus a symbiotic relationship between the steam reforming module and the oxygen combustion chamber where the oxygen combustion chamber provides the thermal energy to heat the steam reforming module, and the steam reforming module provides further carbon-based fuel which in turn, generates further energy. As such, In embodiments, the method further comprises separating the syngas into a carbon-based gas stream and a hydrogen gas stream; and passing the carbon-based gas stream into the oxygen combustion module.

The oxygen combustion chamber is in energy communication with the turbine. In embodiments, the turbine forms part of a power module comprising the turbine and a fluid input line. In embodiments, the fluid input line is in thermal communication with the oxygen combustion chamber such that the thermal energy generated in the oxygen combustion chamber is configured to heat a working fluid (e.g. water) contained within the fluid input line (e.g. to generate steam). In embodiments, the turbine is in fluid communication with, and downstream of, the fluid input line such that working fluid (e.g. water/steam) heated by the oxygen combustion chamber is passed to the turbine. The turbine may then convert the energy from the flow of the working fluid to work. In embodiments, the method comprises heating a working fluid in a fluid input line before passing the working fluid to the turbine to convert the energy from the flow of the working fluid to work.

In embodiments, the oxygen combustion chamber is configured to heat a working fluid held within a closed loop system. In embodiments, the closed loop system comprises the turbine and a pump configured to move the working fluid around the closed loop system. For example, the fluid input line may be configured to extend between the pump and the turbine. For example, the working fluid that has passed through the turbine may be passed back to the pump for recirculation. In embodiments, the method comprises heating a working fluid within a closed loop system comprising the turbine, wherein the energy of the flow of the working fluid through the turbine is converted to work.

In embodiments, the closed loop system further comprises a condenser unit configured to convert gaseous-phase working fluid, output from the turbine, into liquid-phase working fluid. Thus, in embodiments, the method comprises condensing the working fluid (e.g. steam) output from the turbine (e.g. to liquid water), and may comprise passing the condensed working fluid (e.g. water) back to the pump for recirculation in the closed loop system.

In embodiments, the turbine is in direct communication with a shaft of the compressor, wherein the turbine is configured to move the shaft of the compressor. Thus, movement of the turbine by the flow of the working fluid passing therethrough results in movement of the shaft of the compressor, which in turn causes the compressor to compress a fluid (e.g. gas, e.g. carbon dioxide gas) contained therein. In embodiments, the turbine is coupled to a generator, wherein the generator is configured to generate electricity to power the compressor. Thus, movement of the turbine by the flow of the working fluid passing therethrough results in generation of electricity in the generator which is, in turn, provided to the compressor.

The generator may be any suitable and/or desirable generator known in the art. In embodiments, the generator comprises (e.g. is) a permanent magnet (PM) motor.

Detailed Description of Example Embodiments The following description presents particular examples and, together with the drawings, serves to explain principles of the disclosure. However, the scope of the disclosure is not intended to be limited to the precise details of the examples, since variations will be apparent to a skilled person and areas deemed to be covered by the description. Terms for components used herein should be given a broad interpretation that also encompasses equivalent functions and features. In some cases, alternative terms for structural features may be provided but such terms are not intended to be exhaustive.

Descriptive terms should also be given the broadest possible interpretation; e.g. the term "comprising" as used in this specification means "consisting at least in part of" such that interpreting each statement in this specification that includes the term "comprising", features other than that or those prefaced by the term may also be present. Related terms such as "comprise" and "comprises" are to be interpreted in the same manner.

The description herein refers to examples with particular combinations of features, however, it is envisaged that further combinations and cross-combinations of compatible features between embodiments will be possible. Indeed, isolated features may function independently as an disclosure from other features and not necessarily require implementation as a complete combination.

Figure 2:
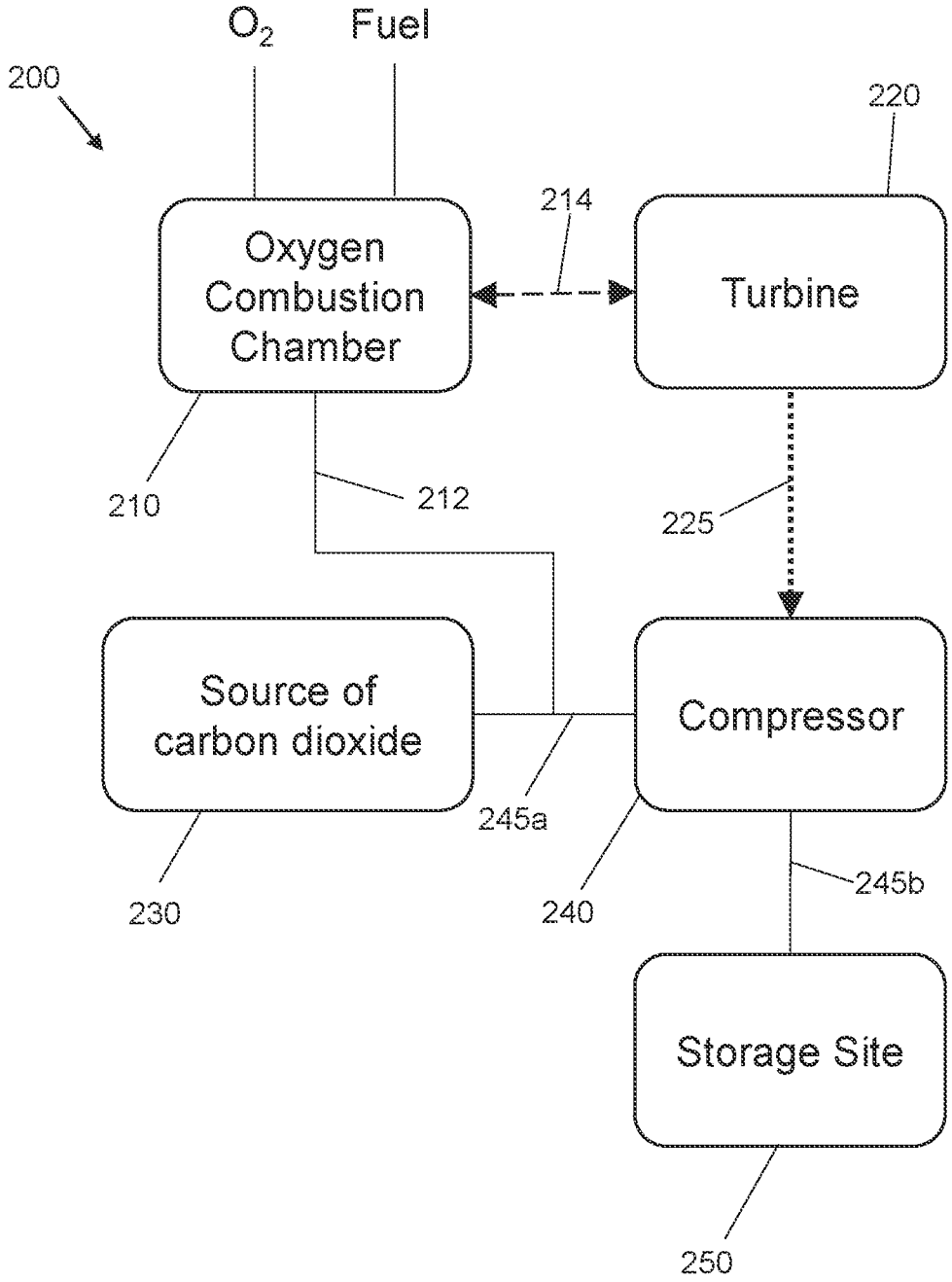
FIG. 2 shows a schematic representation of a carbon dioxide injection line compression system in accordance with another example embodiment of the present disclosure.
Figure 3:
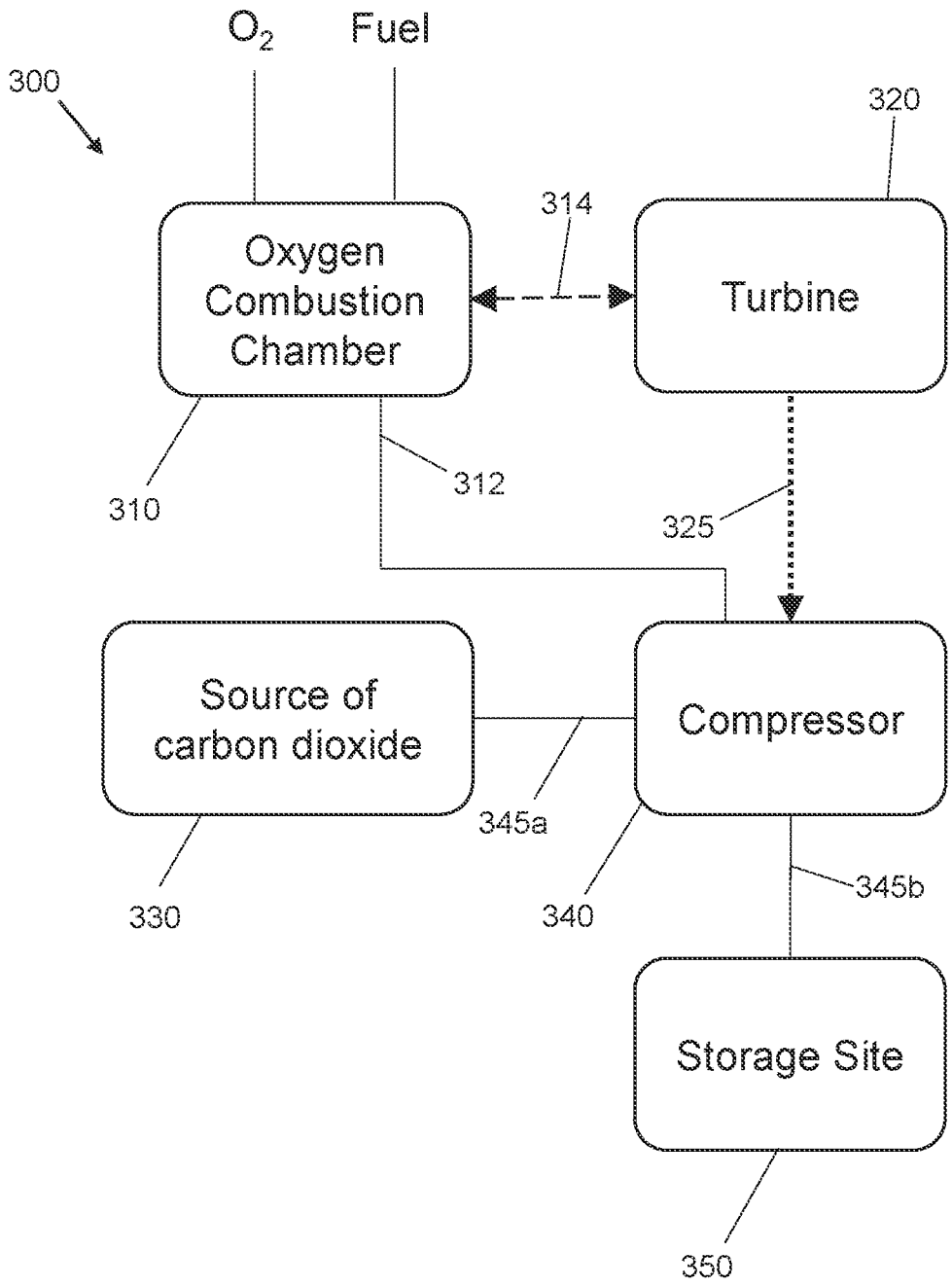
FIG. 3 shows a schematic representation of a carbon dioxide injection line compression system in accordance with another example embodiment of the present disclosure.

FIGS. 1, 2 and 3 show different embodiments of a carbon dioxide injection line compression system 100, 200, 300 that differ in the arrangement of the communication between the oxygen combustion chamber output 112, 212, 312 and the storage site 150, 250, 350.

FIG. 1 shows a schematic representation of a carbon dioxide injection line compression system 100 comprising a compressor 140 for compressing carbon dioxide gas from a source of carbon dioxide gas 130 such as a process plant prior to storing the carbon dioxide gas at a storage site 150. The carbon dioxide is transported from the carbon dioxide source 130 to the storage site 150 via the main carbon dioxide storage line 145*a*, 145*b*. The main carbon dioxide storage line comprises the compressor 140 such that the carbon dioxide input (via the main line 145*a*) is compressed upstream of the storage site 150. A turbine 120 is in communication 125 with the compressor 140 and is configured to drive the compressor 140.

The oxygen combustion chamber 110 is configured to combust or burn a fuel, input from line 104, in an oxygen-rich atmosphere, with the oxygen input from line 102. As a result, a gaseous mixture comprising carbon dioxide and water is produced within the oxygen combustion chamber 110. The carbon dioxide can then then transferred, via output line 112, to the main carbon dioxide line 145*b* output from the compressor 140, upstream of the storage site 150.

The combustion process also generates heat energy which can be used in downstream processes with a view to providing a more energy efficient system. As such, the turbine 120 is in energy communication 114 with an oxygen combustion chamber 110 such that the "waste" heat energy is transferred from the oxygen combustion chamber to the turbine 120, the movement of which then results in the compressor 125 being driven. The compression of the carbon dioxide upstream of the storage site 150 may therefore be performed without any external energy sources, improving energy efficiency, which in turn reduces the costs of running the carbon dioxide injection line compression system 100. Alternatively, the energy required by to compress the carbon dioxide may be supplemented with a further energy source.

FIG. 1 thus shows an embodiment of a carbon dioxide injection line compression system 100 wherein the carbon dioxide generated in the oxygen combustion chamber 110 has a pressure that is sufficient to be directly input (e.g. injected) into a storage site 150 without itself needing to be compressed.

FIG. 2, in contrast, shows a carbon dioxide injection line compression system 200 which differs from the embodiment of FIG. 1 in that the carbon dioxide generated within the oxygen combustion chamber 210 is compressed by the compressor 240 before being transferred to the storage site 250. This may be used, for example, if the carbon dioxide generated in the oxygen combustion chamber 210 is generated at low pressures, i.e. the carbon dioxide generated has a pressure that would be unsuitable for storage without being first compressed.

As such, the carbon dioxide injection line compression system 200 comprises an oxygen combustion chamber 210 in energy communication 214 with a turbine 220 which is in turn configured to drive 225 a compressor 240. The compressor 240 may be configured to receive carbon dioxide from an upstream source of carbon dioxide 230, such as a process plant, via the main line 245*a*, as well as the carbon dioxide generated by the combustion process in the oxygen combustion chamber 210. The carbon dioxide output 212 from the oxygen combustion chamber may be added to the main carbon dioxide line 245*a* prior to the carbon dioxide being input to the compressor 240. The compressor 240 then compresses the carbon dioxide to the desired pressure before being transferred to the storage site, e.g. an underground well, via the main carbon dioxide line 245*b*.

FIG. 3 shows an embodiment of a carbon dioxide injection line compression system 300 wherein the carbon dioxide generated by the combustion process in the oxygen combustion chamber 310 is greater than the input pressure of the compressor, but less than the output pressure of the compressor. In other words, the pressure of the carbon dioxide generated in the oxygen combustion chamber 310 is greater than the pressure of the carbon dioxide configured to be received by the compressor and less than the pressure required for storage at the storage site 350. As such, the carbon dioxide gas output from the oxygen combustion chamber 310 needs to be compressed to an extent.

In such an embodiment, the compressor 340 may have a plurality of compression stages, wherein each stage compresses the carbon dioxide gas to a greater extent than the previous stage. As such, the output line 112 may be configured to be in communication with a suitable compression stage such that the carbon dioxide gas is input to the main carbon dioxide storage line 345*a*, 345*b* at an intermediary (or subsequent) stage of the compressor 340 that will result in an increase of pressure of the carbon dioxide gas.

With the exception of the arrangement of the compressor 340, the system 300 is similar to the systems 100 and 200 shown in FIGS. 1 and 2. Namely, the. carbon dioxide injection line compression system 300 comprises an oxygen combustion chamber 310 in energy communication 314 with a turbine 320 which is in turn configured to drive 325 a compressor 340. The compressor 340 may be configured to receive carbon dioxide from an upstream source of carbon dioxide 330, such as a process plant, via the main carbon dioxide line 345*a*, as well as the carbon dioxide generated by the combustion process in the oxygen combustion chamber 310, via the output 312. (Although, it will be appreciated that in some embodiments the combustion process may be the source of carbon dioxide, i.e. the source of carbon dioxide 330 may be omitted.) The compressor 330 then compresses the carbon dioxide to the desired pressure before being transferred to the storage site 50, e.g. an underground well, via the main carbon dioxide storage line 345*b*.

Figure 4:
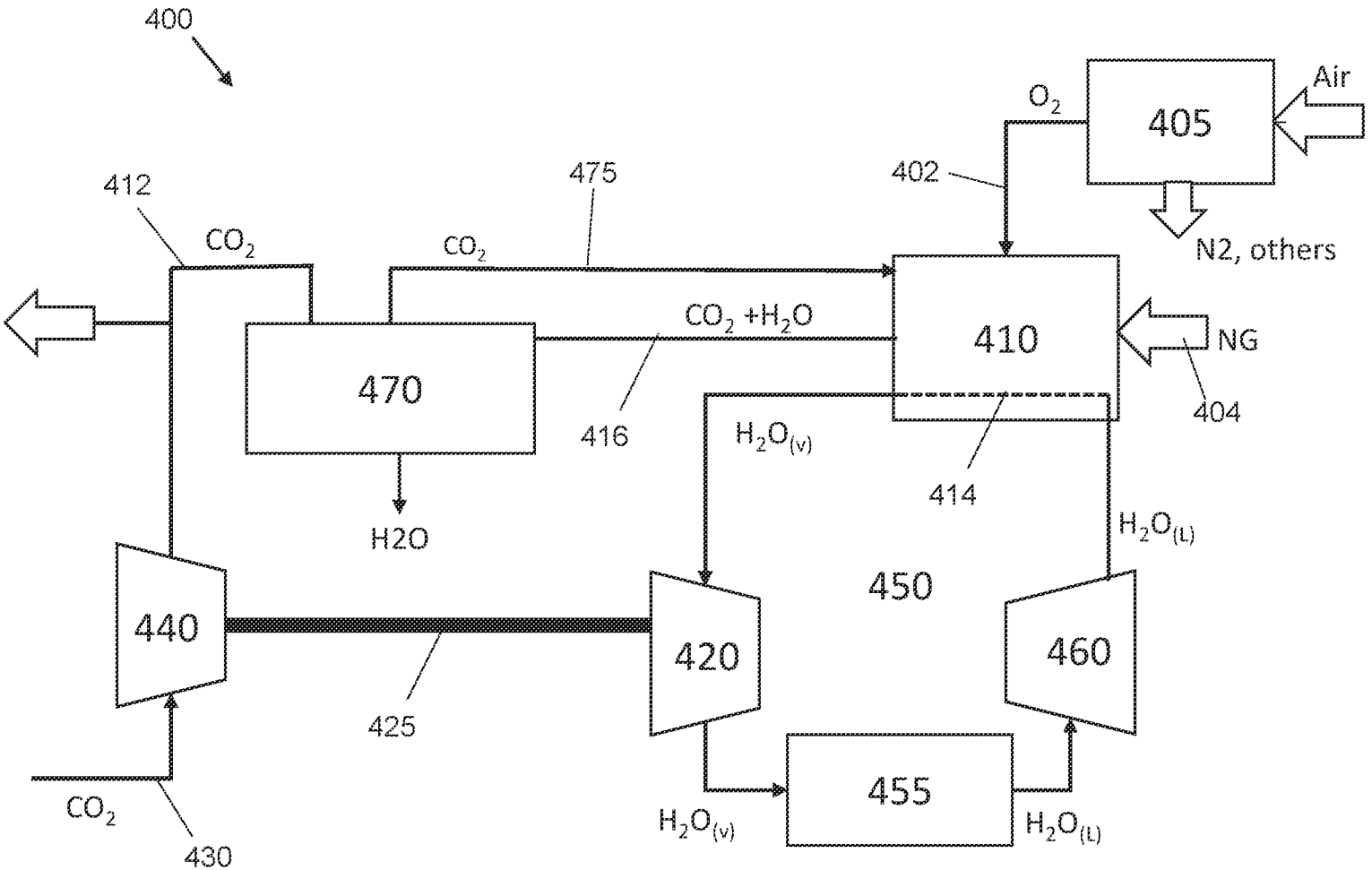
FIG. 4 shows a schematic representation of a carbon dioxide injection line compression system in accordance with another example embodiment of the present disclosure.

FIG. 4 shows a carbon dioxide injection line compression system 400. Air is input into an air separation unit 405 to provide a source of oxygen for the oxygen combustion chamber 410 via input like 402. Natural gas is also input into the oxygen combustion chamber 410 via input line 404. Combustion of the carbon dioxide and the natural gas generates carbon dioxide and water (in the form of steam) is output via line 416 into a purification unit 470 which separates water from the carbon dioxide. A portion of the carbon dioxide is recirculated back into the oxygen combustion chamber 410 via line 475 to provide control of the combustion reaction (e.g. to influence temperature and/or pressure). This may be controlled by a valve, a flowmeter, or by another compressor in the line. The remainder of the (purified or separated) carbon dioxide is output from the purification unit 470, via line 412. In the embodiment shown, the carbon dioxide output from the purification unit 470 is input (e.g. injected) directly to the storage site. However, it will be appreciated that the embodiment may be modified such that the carbon dioxide output from the purification unit 470 is provided to the compressor 440 to be compressed upstream of the storage site, for example, if the carbon dioxide is output at a pressure that is too low for storage.

In this embodiment, the turbine 420 of the carbon dioxide injection line compression system 400 is included within a closed loop system 450, which, in addition to the turbine 420, includes a condenser 455, and a pump 460 that is configured to circulate a working fluid (in this case water) around the closed loop system 450. The closed loop system 450 is provided in energy communication 414 with the oxygen combustion chamber 410. In some embodiments, this energy communication 414 may result from a portion of the closed loop system pipelines being in physical contact with the oxygen combustion chamber 410 such that heat generated in the oxygen combustion chamber 410 is used to heat the working fluid contained within said pipeline (thus acting as a heat exchanger). When the working fluid is water, this may result in vaporisation of liquid water to steam which can then be passed to the turbine 420 such that the flow of the steam through the turbine 420 is converted to work. On output from the turbine 420, the steam/water working fluid may be passed to the condenser 455 to convert any remaining steam back to liquid water, before being redirected to the pump for further circulation.

The turbine 420 is in communication 425 with the compressor 440 such that the turbine drives the compressor 440 and causes compression of carbon dioxide from a carbon dioxide source via the main carbon dioxide storage line 430 (and/or the carbon dioxide from the purification unit 470 if so configured). For example, the turbine 420 may be connected to a shaft of the compressor 440 such that work is done on the shaft when the working fluid flows through the turbine 420, causing the shaft to move and thus compress any carbon dioxide gas contained therein.

Figure 5:
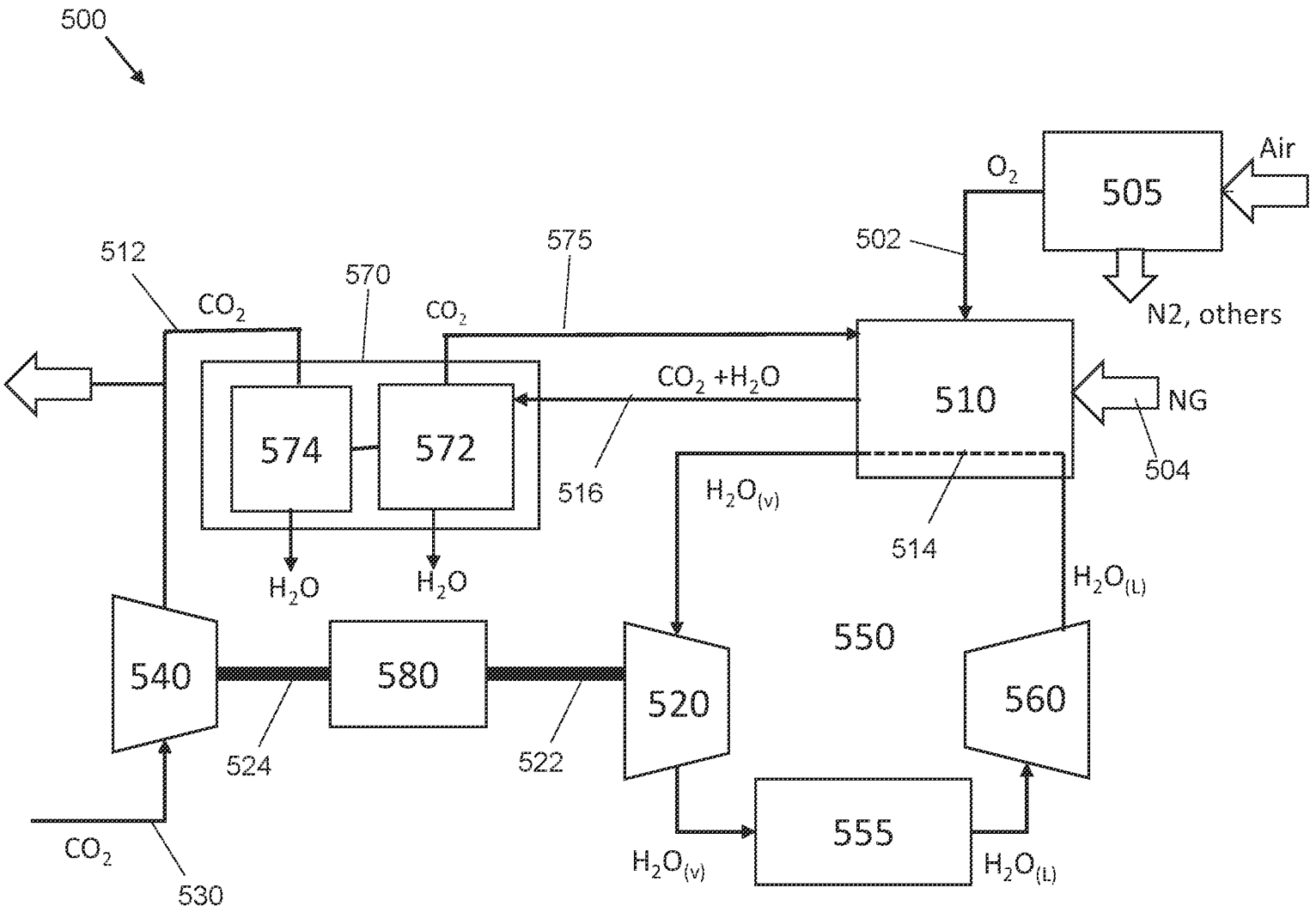
FIG. 5 shows a schematic representation of a carbon dioxide injection line compression system in accordance with another example embodiment of the present disclosure.

FIG. 5 shows a carbon dioxide injection line compression system 500 which is similar in nature to the carbon dioxide injection line compression system 400 shown in FIG. 4. As with system 400, air is input into an air separation unit 505 to provide a source of oxygen for the oxygen combustion chamber 510 via input like 502. Natural gas is also input into the oxygen combustion chamber 510 via input line 504. Combustion of the carbon dioxide and the natural gas then generates carbon dioxide and water (in the form of steam) is output via line 516 into a purification unit 570 which separates water from the carbon dioxide.

However, in contrast to system 400, the purification unit 570 of the carbon dioxide injection line compression system 500 comprises a separation unit 572 and a dehydration unit 574. Output line 516 is input to the separation unit 572 where some water is separated from the carbon dioxide and output from the system. A portion of the carbon dioxide is then recirculated back to the oxygen combustion chamber 510 via the first carbon dioxide output 575 whilst the remainder of the carbon dioxide is transferred to the dehydration unit 574 to remove, and output via a second carbon dioxide output, any remaining water. The dehydration unit 574 then outputs carbon dioxide, via a third carbon dioxide output 512, to be input (e.g. injected) directly to the storage site. However, it will be appreciated that the embodiment may be modified such that the carbon dioxide output from the purification unit 570 is provided to the compressor 540 to be compressed upstream of the storage site, for example, if the carbon dioxide is output at a pressure that is too low for storage.

As with system 400, the turbine 520 of the carbon dioxide injection line compression system 500 is included within a closed loop system 550, which, in addition to the turbine 520, includes a condenser 555, and a pump 560 that is configured to circulate a working fluid (in this case water) around the closed loop system 550. The closed loop system 550 is provided in energy communication 514 with the oxygen combustion chamber 510.

The closed loop system 550 converts the flow of the working fluid to work in the turbine 520 in the same way as described above for the closed loop system 450 of system 400. However, in this embodiment, the turbine 520 is connected 522 to a generator 580 such that the work of the turbine is converted to electricity in the generator 580. The generator 580 is then electrically connected 524 to the compressor 540 such that the electricity generated in the generator 580 is used to power the compressor 540 to compress any carbon dioxide gas contained therein, e.g. from a carbon dioxide source in the main carbon dioxide storage line 530 or the purification unit 570.

Figure 6:
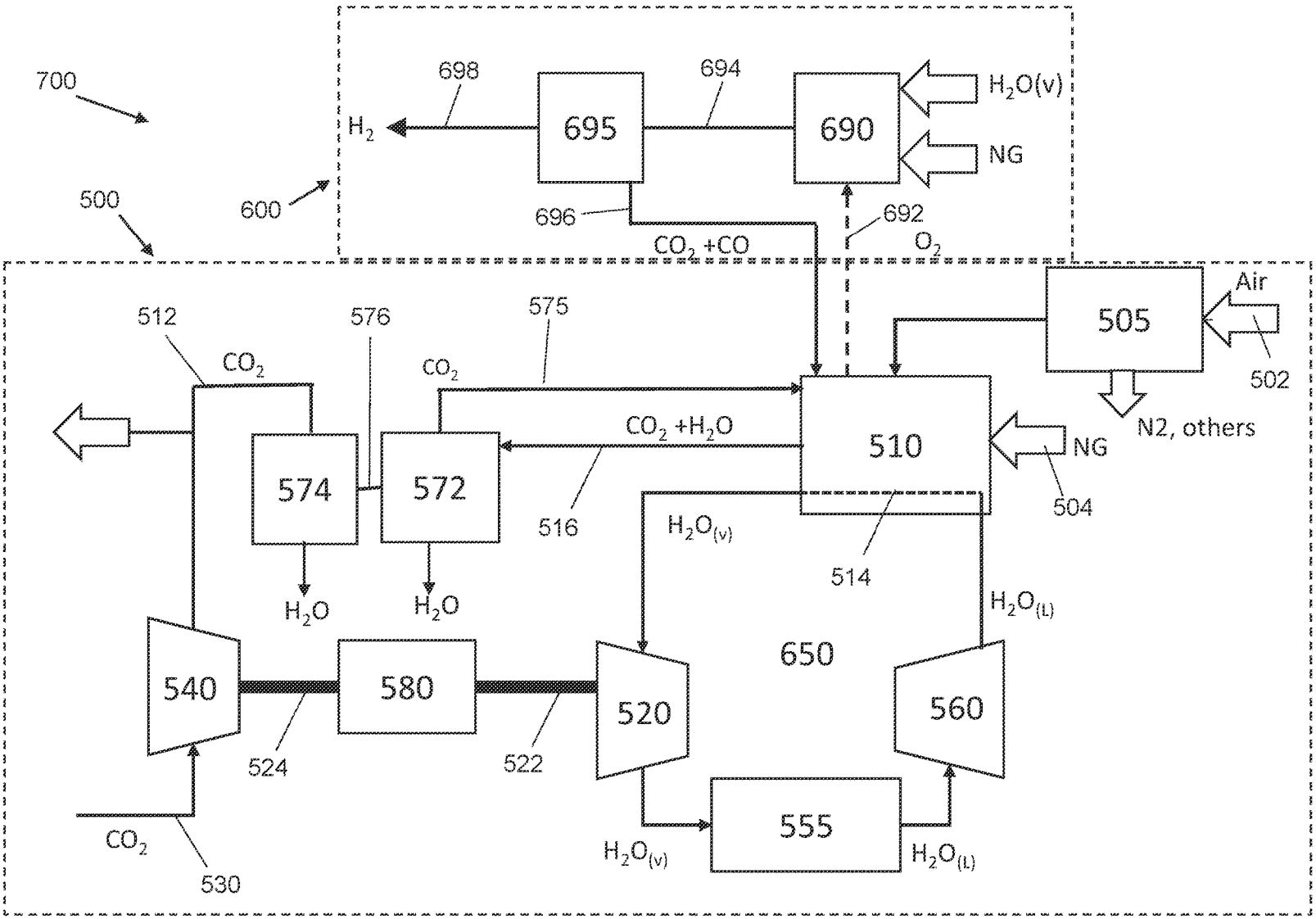
FIG. 6 shows a schematic representation of a carbon dioxide injection line compression system in accordance with another example embodiment of the present disclosure.

FIG. 6 shows a carbon dioxide injection line compression system 700 that includes the system 500 of FIG. 5 in addition to a steam reforming module 600. It will, however, be appreciated that the steam reforming module 600 may be added to any one of systems 100, 200, 300, 400 shown in FIGS. 1 to 4 in the same way as shown for the system 500 of FIG. 5.

In system 700, the oxygen combustion chamber 510 (or oxygen combustion chamber 110, 210, 310, 410) is in energy communication 692 with a reactor module 690 of the steam reforming module 600. As such, in addition to heat being transferred (e.g. exchanged) with the closed loop system 500, heat generated in the oxygen combustion chamber 510 is also transferred to the steam reforming module 690 to heat the contents therein.

In the embodiment shown, steam and natural gas are input to the steam reforming module 690 where they are heated (for example, in the presence of a catalyst) to generate a synthesis gas (syngas) (e.g. a mixture of carbon rich gas and hydrogen). This mixture is then output from reactor unit 690 to a separation module 695, via line 694, where the syngas is separated into a carbon-based gas stream 696 and a hydrogen gas stream 698. The carbon rich gas stream 696 (comprising carbon dioxide and carbon monoxide) is output to the oxygen combustion chamber 510 to provide a further source of fuel to be combusted.

Figure 7:
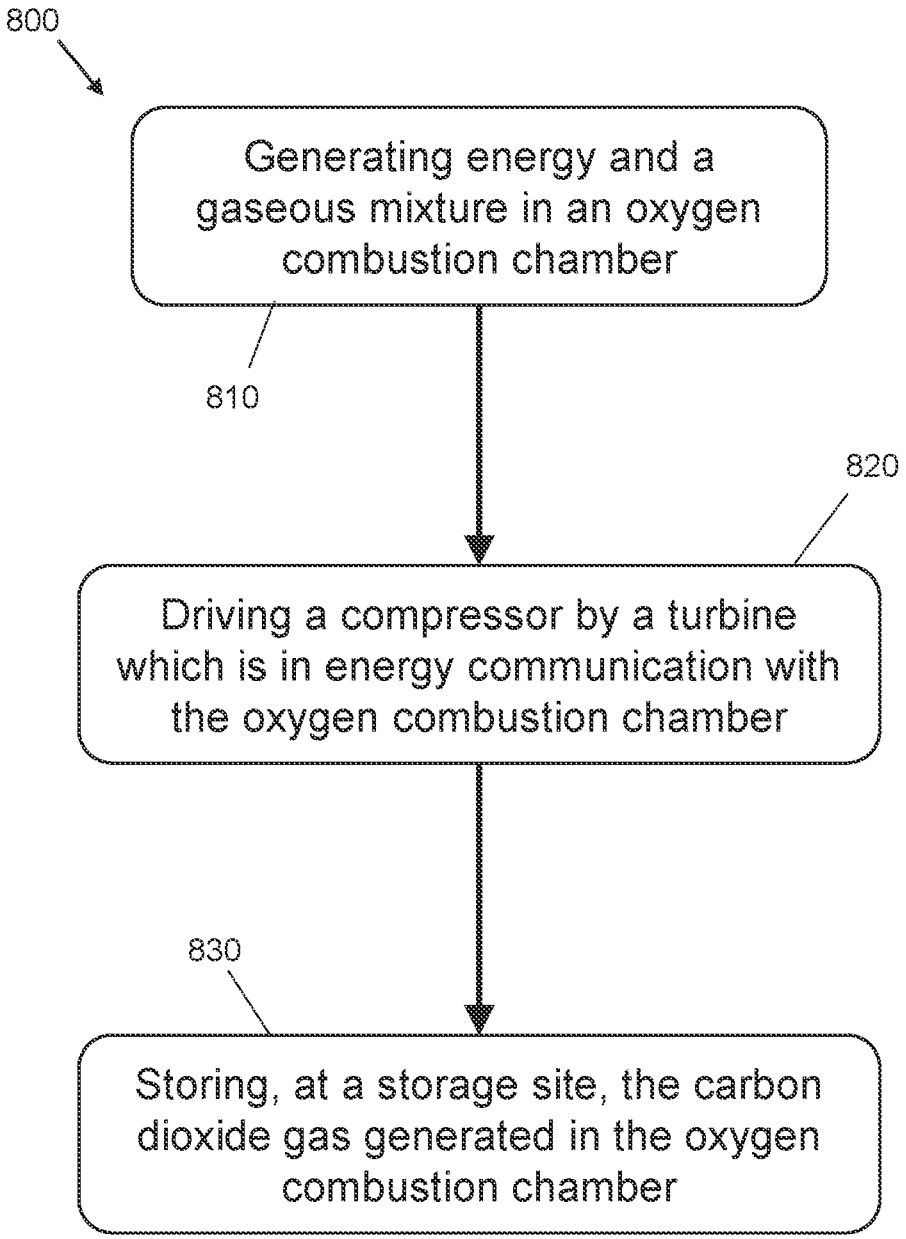
FIG. 7 shows a schematic representation of a carbon dioxide injection line compression system in accordance with another example embodiment of the present disclosure.

FIG. 7 shows a flow diagram 800 representing a method for carbon capture and storage. It will be appreciated that even though the flow diagram shows the different steps of the method 800 in a particular sequence, the method steps may be performed in any suitable and/or desirable order that makes technical sense.

In a first step, the method involves generating 810 energy and a gaseous mixture comprising steam and carbon dioxide by burning fuel in an oxygen rich environment in an oxygen combustion chamber, for example, the oxygen combustion chamber 110, 210, 310, 410, 510 shown in the systems 100, 200, 300, 400, 500 shown in FIGS. 1 through 5.

The oxygen combustion chamber (such as the oxygen combustion chamber 110, 210, 310, 410, 510 shown in systems 100, 200, 300, 400, 500 shown in FIGS. 1 to 5) is in energy communication with a turbine. As such, in a second step, the method comprises driving 820 a compressor by the turbine such that the carbon dioxide from an (e.g. external) carbon dioxide source is compressed prior to storing 830 the carbon dioxide at the storage site.

The carbon dioxide generated in the oxygen combustion chamber (such as the oxygen combustion chamber 110, 210, 310, 410, 510 shown in systems 100, 200, 300, 400, 500 shown in FIGS. 1 to 5) is then transferred to a storage site.

The method 800 may further comprise storing, at a storage site, the carbon dioxide gas generated in an oxygen combustion chamber (such as the oxygen combustion chamber 110, 210, 310, 410, 510 shown in the systems 100, 200, 300, 400, 500 shown in FIGS. 1 to 5).

It should be noted that the carbon dioxide injection line compression systems 100, 200, 300, 400, and 500 shown in FIGS. 1 through 5 may be interchangeably described as carbon capture and storage systems 100, 200, 300, 400, and 500. It is to be understood that the above description is intended to be illustrative, and not restrictive. Many other implementations will be apparent to those of skill in the art upon reading and understanding the above description. Although the disclosure has been described with reference to specific example implementations, it will be recognised that the disclosure is not limited to the implementations described but can be practiced with modification and alteration within the scope of the appended claims. Accordingly, the specification and drawings are to be regarded in an illustrative sense rather than a restrictive sense. The scope of the disclosure should, therefore, be determined with reference to the appended claims, along with the full scope of equivalents to which such claims are entitled.

What is claimed is:

1. A carbon dioxide injection line compression system, comprising:

a main carbon dioxide storage line connecting a carbon dioxide source with a storage site, the storage site is one of an underground reservoir or well, a depleted oil or gas field, or a deep rock reservoir beneath the sea, such that the main carbon dioxide storage line is configured to transport a first carbon dioxide gas flow from the carbon dioxide source to the storage site, the main carbon dioxide storage line comprising a compressor, wherein the compressor is in fluid communication with, and upstream of, the storage site, and wherein the compressor is configured to compress the first carbon dioxide gas flow from the carbon dioxide source prior to storing the carbon dioxide gas at the storage site;

a turbine configured to drive the compressor; and an oxygen combustion chamber configured to burn a fuel in an oxygen rich environment to generate energy and a gaseous mixture comprising a second carbon dioxide gas flow and steam, wherein, at least a part of the energy generated is used to drive the turbine; and wherein the oxygen combustion chamber is in fluid communication with, and upstream of, the storage site such that the second carbon dioxide gas flow generated in the oxygen combustion chamber is added to the main carbon dioxide storage line.

2. The carbon dioxide injection line compression system of claim 1, wherein, the second carbon dioxide gas flow generated in the oxygen combustion chamber is added to the main carbon dioxide storage line upstream of the compressor.

3. The carbon dioxide injection line compression system of claim 1, wherein the second carbon dioxide gas flow generated in the oxygen combustion chamber is added to the main carbon dioxide storage line downstream of an output of the compressor.

4. The carbon dioxide injection line compression system of claim 1, wherein the compressor includes a plurality of compression stages comprising a first compression stage and one or more subsequent compression stages; and wherein the second carbon dioxide gas flow generated in the oxygen combustion chamber is added to the main carbon dioxide storage line at one of the one or more subsequent compression stages.

5. The carbon dioxide injection line compression system of claim 1, further comprising:

a steam reforming module configured to generate hydrogen from natural gas and steam, wherein the steam reforming module is in communication with the oxygen combustion chamber such that at least a part of the energy generated in the oxygen combustion chamber is configured to heat the steam and natural gas within the steam reforming module.

6. The carbon dioxide injection line compression system of claim 5, wherein the energy generated in the oxygen combustion chamber is the sole heat source used to heat the steam and natural gas within the steam reforming module, and wherein the steam and natural gas is heated to temperatures from seven-hundred degrees Celsius (700° C.) to one-thousand one-hundred degrees Celsius (1100° C.).

7. The carbon dioxide injection line compression system of claim 5, wherein the steam reforming module comprises:

a reactor module in communication with the oxygen combustion chamber such that heat from the oxygen combustion chamber is transferred to the reactor module, wherein the reactor module is configured to generate a synthesis gas (syngas) by heating natural gas in the presence of steam and a catalyst; and a separation module in fluid communication with, and downstream of, the reactor module, wherein the separation module is configured to separate the syngas into a carbon-based gas stream and a hydrogen gas stream; and wherein the separation module is configured to input the carbon-based gas stream to the oxygen combustion chamber.

8. The carbon dioxide injection line compression system of claim 1, wherein the oxygen combustion chamber is configured to heat a working fluid held within a closed loop system, wherein the closed loop system further comprises the turbine and a pump configured to move the working fluid around the closed loop system.

9. The carbon dioxide injection line compression system of claim 8, wherein the closed loop system further comprises a condenser unit configured to convert gaseous-phase working fluid, output from the turbine, into liquid-phase working fluid.

10. The carbon dioxide injection line compression system of claim 1, further comprising:

a purification module configured to separate the second carbon dioxide gas flow in the gaseous mixture from the water in the gaseous mixture.

11. The carbon dioxide injection line compression system of claim 10, wherein the purification module comprises a separation unit in fluid communication with, and upstream of, a dehydration unit, wherein the separation unit is configured to remove at least some of the water from the gaseous mixture to provide a carbon dioxide rich stream that is passed to the dehydration unit, and wherein the dehydration unit is configured to further dehydrate the carbon dioxide rich stream.

12. The carbon dioxide injection line compression system of claim 1, wherein the turbine is in direct communication with a shaft of the compressor, and wherein the turbine is configured to move the shaft.

13. The carbon dioxide injection line compression system of claim 1, wherein the turbine is coupled to a generator, wherein the generator is configured to generate electricity to power the compressor.

14. A method for carbon dioxide injection compression comprising:

generating energy and a gaseous mixture comprising steam and a first carbon dioxide gas flow by burning fuel in an oxygen rich environment in an oxygen combustion chamber;

adding the first carbon dioxide gas flow generated in the oxygen combustion chamber to a main carbon dioxide storage line, wherein the main carbon dioxide storage line extends between a carbon dioxide source and a storage site, the carbon dioxide source supplying a second carbon dioxide gas flow to the storage site, and wherein the main carbon dioxide storage line comprises a compressor;

driving the compressor to compress the second carbon dioxide gas flow provided thereto upstream of the storage site, wherein the compressor is driven by a turbine and the turbine is driven by the energy generated in the oxygen combustion chamber; and transporting the carbon dioxide in the main storage line to the storage site, wherein the storage site is one of an underground reservoir or well, a depleted oil or gas field, or a deep rock reservoir beneath the sea.

15. The method of claim 14, further comprising:

adding the first carbon dioxide gas flow generated in the oxygen combustion chamber to the main storage line upstream of the compressor such that the first carbon dioxide gas flow is compressed and pressurised upstream of the storage site.

16. The method of claim 14, further comprising:

adding the first carbon dioxide gas flow generated in the oxygen combustion chamber to the main storage line downstream of the compressor to provide a mixed stream of pressurised carbon dioxide; and transporting the mixed stream of pressurised carbon dioxide to the storage site.

17. The method of claim 14, further comprising:

generating a synthesis gas (syngas) in a steam reforming module by heating a mixture of natural gas and steam to a temperature between seven-hundred degrees Celsius (700° C.) to one-thousand one-hundred degrees Celsius (1100° C.) in the presence of a catalyst, wherein the thermal energy generated in the oxygen combustion chamber is used as the source of heat to heat the steam reforming module.

18. The method of claim 17, wherein the method further comprises:

separating the syngas into a carbon-based gas stream and a hydrogen gas stream; and passing the carbon-based gas stream into the oxygen combustion module.

19. The method of claim 14, further comprising:

separating, in a purification module, the first carbon dioxide gas flow in the gaseous mixture from the water in the gaseous mixture.

20. The method of claim 19, further comprising:

recirculating a portion of the first carbon dioxide gas flow separated in the purification module back into the oxygen combustion chamber; and outputting a portion of the first carbon dioxide gas flow separated in the purification module to the storage site.

* * * * *